United States Patent [19]

Rodaway

[11] 4,176,879

[45] Dec. 4, 1979

[54] WHEELCHAIR FOOT REST LATCH

[75] Inventor: Keith S. Rodaway, Santa Monica, Calif.

[73] Assignee: Everest & Jennings, Inc., Los Angeles, Calif.

[21] Appl. No.: 929,332

[22] Filed: Jul. 31, 1978

[51] Int. Cl.[2] ..... A47C 7/50

[52] U.S. Cl. ..... 297/429

[58] Field of Search ..... 297/429

[56] References Cited

U.S. PATENT DOCUMENTS

| | | | |
|---|---|---|---|
| 2,868,275 | 1/1959 | Mize | 297/429 |
| 3,854,774 | 12/1974 | Limpach | 297/429 |

FOREIGN PATENT DOCUMENTS

| | | | |
|---|---|---|---|
| 1344688 | 1/1974 | United Kingdom | 297/429 |

*Primary Examiner*—James C. Mitchell

*Attorney, Agent, or Firm*—Ralph B. Pastoriza

[57] ABSTRACT

The latch is used to raise a downwardly biased plunger on the frame of a wheelchair normally received in an opening on a swingable foot rest supporting tube to thereby release the tube and permit swinging of the wheelchair foot rest to an out-of-the-way position. The latch includes a plate member cooperating with a lever such that either pressing downwardly on the lever or lifting up on the lever will release the foot rest support. With this arrangement, even a severely handicapped patient can more easily operate the release than otherwise.

3 Claims, 9 Drawing Figures

WHEELCHAIR FOOT REST LATCH

BACKGROUND OF THE INVENTION

This invention relates generally to wheelchairs and more particularly to a wheelchair foot rest latch for locking and releasing the wheelchair foot rest supports for swinging from first operable positions to out-of-the-way second positions to provide easy access to the wheelchair.

Most conventional wheelchairs include foot rests on foot rest support tubes coupled to the front frame portion of the wheelchair. The foot rest members themselves are usually arranged to pivot upwardly to change the plane of the foot rest from a horizontal to a vertical position to thereby make access to the chair easier for a patient. In addition, the foot rest support tubes themselves in certain designs are arranged to swing to an out-of-the-way position to again provide for easier access to and from the chair. In these latter swingable type structures, the foot rest support tubes themselves can then also be readily removed entirely from the wheelchair if desired.

To secure the swingable type of foot rest support tubes in a first operable position wherein the foot rest members are supported in front of the seat for receiving a patient's feet, each foot rest support tube is provided with a sloping cam surface arranged to engage under a downwardly biased plunger vertically movable in guiding means secured to the front frame of the wheelchair such that when the foot rest support member swings from its out-of-the-way second position towards its first position, it cams the plunger upwardly until the plunger drops in the plunger receiving opening at which point, the foot rest support tube is in its first operable position. In order to release the foot rest support tube, either a patient or nurse must reach forwardly and lift the plunger from the plunger receiving opening, the mechanism presently available for carrying out this operation takes the form of a lever member which must be lifted in order to raise the plunger. The hardware involved even though the mechanism constitutes a small part of the overall wheelchair is relatively expensive and complicated for the particular job it is designed to perform.

A more serious problem from the standpoint of the patient is the fact that the lever must be lifted upwardly in some manner to raise the plunger and thus release the foot rest support tube. For a severely handicapped patient, it might be difficult if not impossible to grasp the lever and raise the same.

SUMMARY OF THE INVENTION

Bearing the foregoing in mind, the present invention contemplates the provision of a greatly improved latch mechanism for locking and releasing foot rest supports for wheelchairs which is not only substantially less expensive than presently available mechanisms but has the distinct advantage of being operable by either a simple downward pushing force or, if desired, the conventional type lifting force.

The advantage of enabling unlocking of the mechanism or unlatching by a simple downward push against a member will be evident in the case of extremely handicapped patients. Such patients are often able to urge a portion of their hand or forearm against a member to push it downwardly as opposed to attempting to grasp underneath a lever arm and lift the same. The advantages of a mechanism operable by simply engaging the same and pushing it downwardly are thus clear.

Briefly, the latch mechanism itself includes basically two metal stampings. First, a plate member is provided secured to the upper end of the locking plunger to overlie the upper exist opening of the guide support or guiding means for the plunger. This plate member also has a portion extending laterally from the vertical axis of movement of the plunger. The second stamping comprises a level member having an end portion passing under the plate member between the plate member and upper end of the guide support or guiding means for the plunger and pivoted about an horizontal axis to the laterally extending portion of the plate member. The other end of the lever member extends in an oppostie direction so that a mid-portion of the lever between its said one end portion and other end is positioned to be engaged by the upper end of the guide support. This upper end of the guiding means or support thus serves as a fulcrum for the lever member such that downward depressing of the lever will raise the plate member and plunger so that only engagement of the upper exposed surface of the lever and a downward force is needed to unlatch the plunger from the foot rest support tube.

On the other hand, the structure is so designed that the usual manner of release can be effected by simply lifting up on the lever to raise the lever, plate member and plunger simultaneously.

Because only two simple metal stampings are required, the overall latch mechanism is extremely economical and can readily be adapted to present day wheelchairs.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
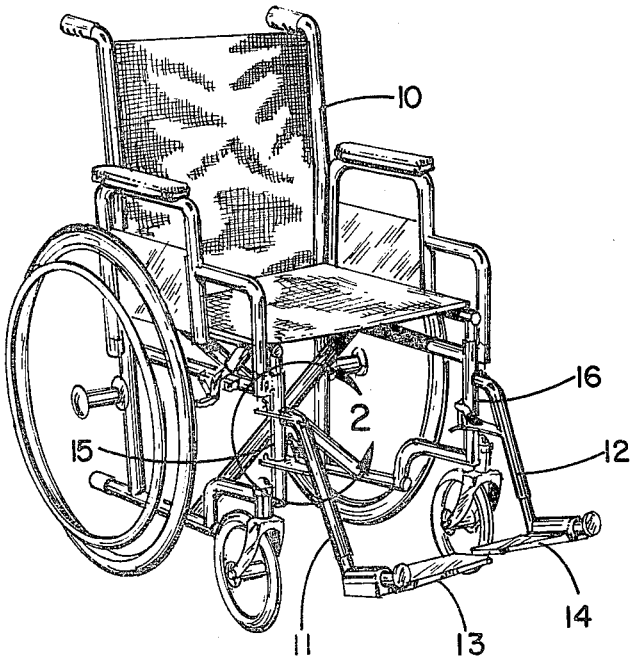
FIG. 1 is a perspective view of a wheelchair incorporating the wheelchair foot rest latch of this invention.

Referring first to FIG. 1 there is shown a wheelchair 10 having foot rest supporting tubes 11 and 12 for foot rest members 13 and 14. These supporting tubes are coupled to forward vertical frame tubes 15 and 16 of the wheelchair 10 as shown.

The latch mechanism for coupling the foot rest support tubes 11 and 12 are identical for each and therefore a detailed description of one will suffice for both.

Figure 2:
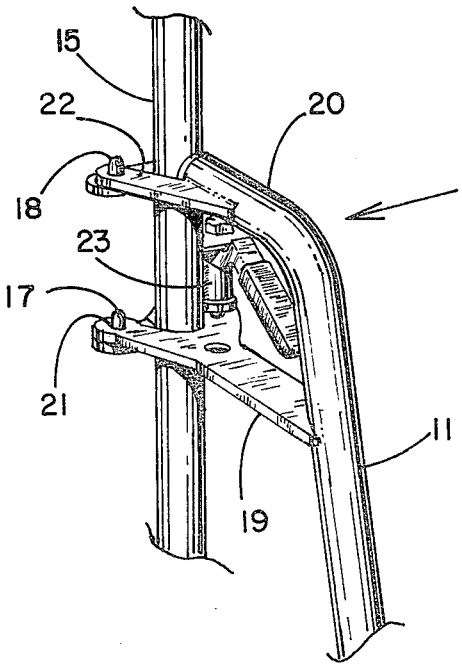
FIG. 2 is an enlarged fragmentary perspective view of the latch mechanism itself enclosed within the circular arrow 2 of FIG. 1.

Accordingly, with reference to FIG. 2 there is shown the latch mechanism for the foot rest supporting tube 11 wherein it will be noted that the vertical frame tube 15 includes a pair of axially spaced upwardly extending pins 17 and 18. The foot rest supporting tube 11 itself includes rearwardly extending portions 19 and 20 having pin receiving openings 21 and 22 receiving the pins 17 and 18 respectively. A plunger guiding means or guide support 23 is shown secured to the tube frame 15 adjacent to one of the pin receiving openings such as 21.

Figure 3:
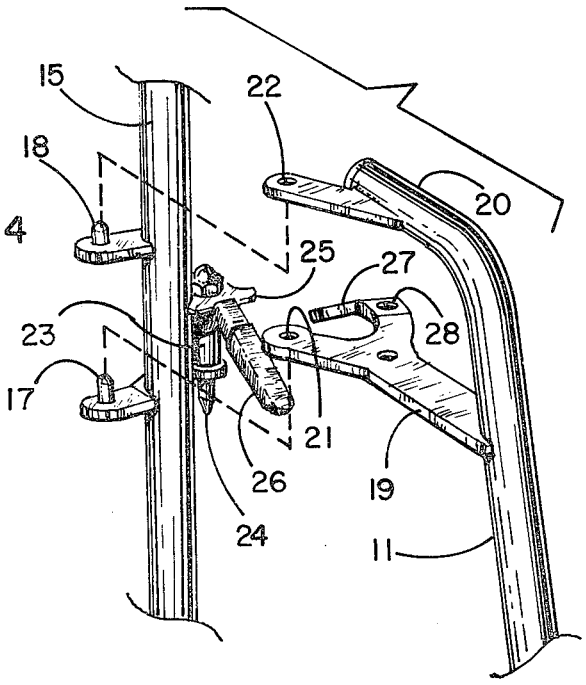
FIG. 3 is a view similar to FIG. 2 but illustrating the foot rest support tube disconnected from the wheelchair frame and latch mechanism.

Referring to FIG. 3 wherein the foot rest supporting tube 11 is shown disconnected from the frame tube 15, it will be noted that the plunger guiding means 23 supports and serves as a vertical guide for a plunger 24. This plunger is arranged to be raised by a plate member 25 secured to the upper end of the plunger at the upper end of the guiding means 23 and a lever 26, all as will become clearer as the description proceeds.

Still referring to FIG. 3, it will be noted that the foot rest supporting tube portion 19 includes a sloping cam surface 27 having a plunger receiving opening 28. This plunger receiving opening 28 is arranged to receive the plunger 24 when the foot rest supporting tube 11 is mounted on the pins 17 and 18 for swinging movement, all as will now become clearer by referring to FIGS. 4 and 5.

Figure 4:
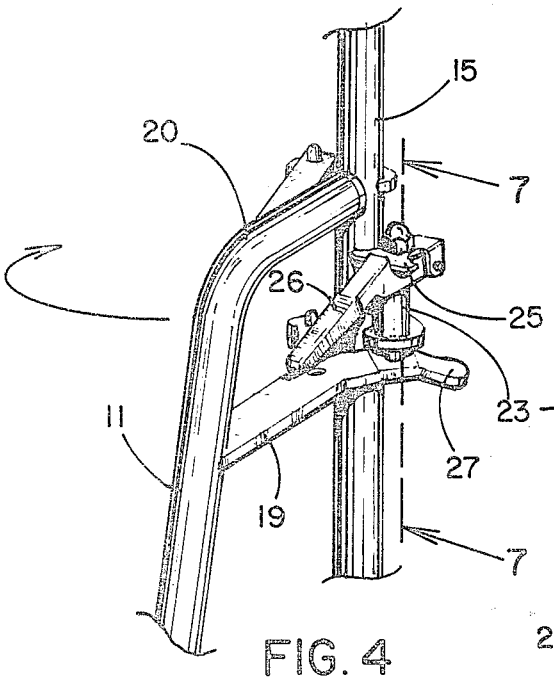
FIG. 4 is another fragmentary view similar to FIG. 2 but looking in the direction of the arrow 4 of FIG. 2 showing the foot rest supporting tube in a first operable position.

Referring first of FIG. 4, the same numerals utilized in FIGS. 2 and 3 designate corresponding parts. FIG. 4 illustrates more clearly the position of the sloping cam surface 27 relative to the plunger guiding means 23 when the foot rest supporting tube 11 is in a first operative locked position. It will be understood that the plunger 24 in the guiding means 23 passes through the plunger receiving opening in the sloping cam surface 27.

Figure 5:
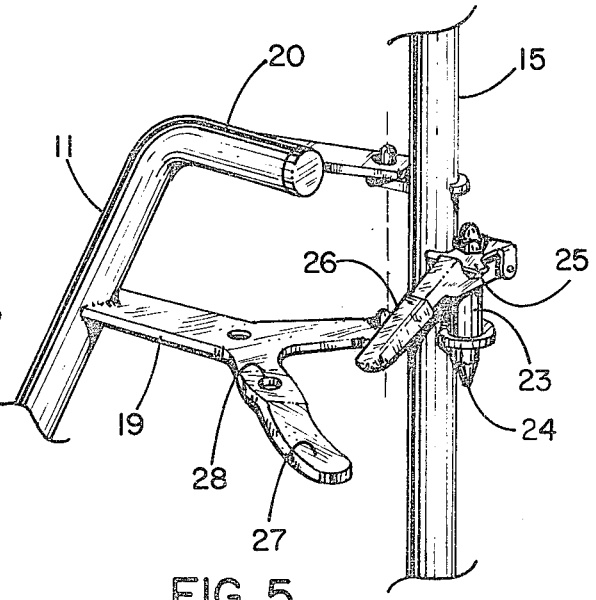
FIG. 5 is a view similar to FIG. 4 but illustrating the foot rest supporting tube in an out-of-the-way second position.

The foregoing is best seen in FIG. 5 which illustrates the foot rest supporting tube 11 in a out-of-the-way second position wherein the plunger receiving opening 28 is free of the plunger 24 in the plunger guiding means 23.

Figure 6:
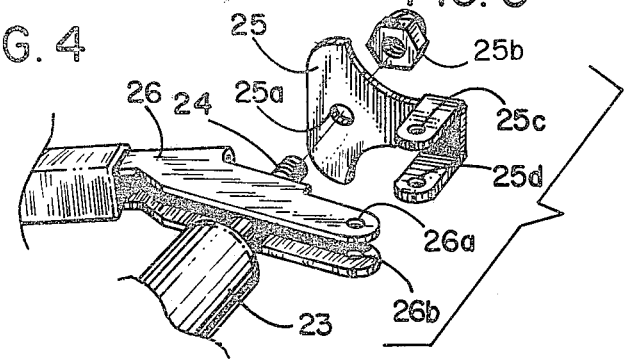
FIG. 6 is an enlarged perspective view of two basic metal stampings constituting part of the latch mechanism of this invention.

Details of the operating mechanism comprising the plate 25 and lever 26 will become clearer by now referring to FIG. 6. The plate member 25 itself which is shown exploded away from the upper end of the plunger 24 has an opening **25*a* receiving the plunger and is secured thereto as by nut 25*b*. Lever plate 25 includes a laterally extending portion spaced from the axis of vertical movement of the plunger 24 terminating in downturned ears 25*c* and 25*d***.

The lever member 26 in turn has one end portion slotted to define arms **26*a* and 26*b* passing on either side of the plunger 24. These arms nest within the ears of the plate 25 and are pivoted at the laterally extending portion of the plate 25**.

Figure 7:
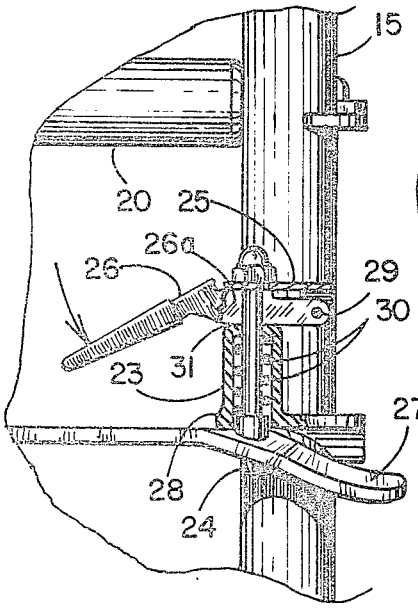
FIG. 7 is an enlarged fragmentary cross sectional view looking in the direction of the arrow 7—7 of FIG. 4.

The plate member 25 and lever 26 in their assembled relationship will be as illustrated in FIG. 7 wherein the pivoting is shown at 29. Also shown in FIG. 7 is a biasing spring 30 in the guiding means 23, this spring 30 normally biasing the plunger in a downward direction. The plate member 25 overlies the upper end of the guiding means 23 which may take the form of a cylindrical collar as shown, the one end portion of the lever 26 passing beneath the plate 25 and upper end surface of the guiding means 23.

It will be seen from the foregoing arrangement that the lower edges of the extending arms such as the arm **26*a* rests on the upper end of the guiding means 23 which serves as a fulcrum designated 31. In the position illustrated in FIG. 7, the plunger 24 is received in the plunger receiving opening 28 so that this position corresponds to the first operative position of the foot rest supporting tube 11 as shown in FIG. 4**.

Figure 8:
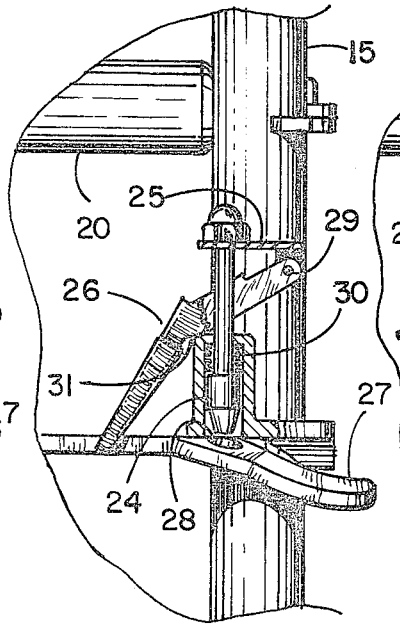
FIG. 8 is a view similar to FIG. 7 illustrating a first mode of operation of the latch; and, FIG. 9 is a view similar to FIG. 7 illustrating a second mode of operation of the latch.

Referring now to FIG. 8, a first mode of operation for releasing the foot rest supporting tube for swinging to the second out-of-the-way position is illustrated. As indicated in FIG. 8, the lever 26 has been depressed downwardly resulting in a rocking movement about the fulcrum 31 to raise the plate member 25 through the pivot connection 29. Raising of the plate member 25 raises the plunger 24 to pull it free of the plunger receiving opening 28 in the sloping cam surface 27. The entire foot rest supporting tube 11 can now be swung from the position illustrated in FIG. 4 to the position illustrated in FIG. 5. The spring 30 will return the plunger to its downwardmost position when the lever 26 is released. Thus, when the foot rest supporting tube 11 is swung from its out-of-the-way position to its first operative position, the lower end of the pin 24 will first be engaged by the sloping cam surface 27 thereby automatically biasing the pin upwardly against the spring bias 30 until the plunger 24 drops into the plunger receiving opening 28.

Figure 9:
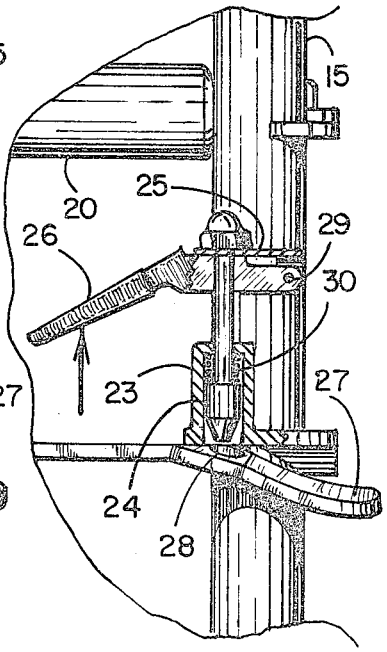

FIG. 9 illustrates a second mode of operation wherein it is only necessary to lift the lever 26 rather than depress downwardly. Thus, it will be evident that if a lifting force is provided on the lever the lever itself along with the plate 25 and plunger 24 will all simultaneously move upwardly as shown to again remove the plunger 24 from the plunger receiving opening 28.

From all of the foregoing, it will be evident that the present invention has provided a vastly improved latch mechanism wherein either a downward depressing force or an upward lifting force will serve to release the foot rest supporting tube to permit it to be swung out-of-the-way. The lever is extremely easy to use by even severely handicapped patients since all it requires is a downward urging.

In addition, it will be evident that the latching components in the form of the plate 25 and lever 26, as described heretofore, can be made by simple stamping operations there being only required two basic pieces. Thus, the cost is vastly reduced over that heretofore required for mechanisms in operating the plunger. Further, the symmetry of the plate and lever renders them usable on either the left or right chair frame or to be used facing forwardly or rearwardly.

Minor changes falling within the scope and spirit of this invention will occur to those skilled in the art. The wheelchair foot rest latch accordingly is not to be thought of as limited to the specific details of the example set forth merely for illustrative purposes.

I claim:

1. In a wheelchair foot rest latch in which a downwardly biased plunger in a guide support on the frame portion of a wheelchair is normally received in a plunger receiving opening on a swingable foot rest supporting tube to lock the same in a given position, (a) a plate member secured to the upper end of said plunger to overlie the upper exit end of said guide support and extending laterally from the vertical axis of movement of said plunger; and (b) a lever member having one end portion passing under said plate member between the plate member and upper end of said guide support and pivoted about an horizontal axis to the end of the laterally extending portion of said plate member, the other end of said lever member extending in an opposite direction so that a mid-portion of the lever between its said one end portion and other end is positioned to be engaged by the upper end of said guide support, said upper end of said guide support serving as a fulcrum for said lever member so that downward movement of said other end of the lever raises said plate member and plunger relative to said guide support, and upward lifting on said other end of said lever raises the lever, plate member and plunger simultaneously whereby said other end of said lever may either be depressed downwardly or lifted upwardly to release the plunger from said plunger receiving opening and thereby permit swinging movement of said foot rest supporting tube to an out-of-the-way position.

2. The subject matter of claim 1, in which said one end portion of said lever is slotted to define arms passing on either side of said plunger, the ends of said arms being pivoted to the laterally extending portion of said plate member.

3. A wheelchair foot rest latch for releasably securing a foot rest member to a wheelchair, including, in combination:

(a) coaxially vertically spaced upwardly extending pins secured to the frame of said wheelchair;

(b) a foot rest supporting tube having rearwardly extending members defining vertically spaced pin receiving openings for receiving said vertically spaced pins to thereby provide for swinging movement of said supporting tube from a first position in which a foot rest member supported by the tube is properly positioned in front of the wheelchair seat to a second out-of-the-way position to allow easy access by a patient into and from the wheelchair seat;

(c) a plunger guiding means secured to said wheelchair frame adjacent to one of said vertically spaced pins;

(d) a plunger passing vertically through said guiding means with its upper and lower ends passing from the upper and lower ends of said guiding means respectively;

(e) spring means in said guiding means biasing said plunger in a vertically downward direction;

(f) a sloping cam surface secured to said foot rest supporting tube and including a plunger receiving opening, the lower end of said plunger being engaged by said cam surface and biased upwardly against said spring bias when said supporting tube is swung from said second towards said first position, said plunger being received in said plunger receiving opening when said foot rest supporting tube reaches said first position to thereby lock said foot rest supporting tube in said first position;

(g) a plate member secured to the upper end of said plunger overlapping the upper end of said guiding means and extending laterally from the vertical axis of movement of said plunger; and (h) a lever member having a slotted portion defining arms passing under said plate members between said plate member and upper end of said guiding means on either side of the upper projecting end of said plunger, the ends of said arms being pivoted about an horizontal axis to the laterally extending end portion of said plate member, the upper end of said guiding means being positioned to engage the under edge of the arms of said lever member between the pivoting point of the ends of said arms and the ends of the lever member opposite the ends of said arms so as to serve as a fulcrum for the under edge of the arms of said lever member so that downward movement of the ends of said lever member opposite the ends of said arms raises said plate member and plunger relative to said guiding means, and also upward lifting on said end of said lever raises said lever, plate member and plunger simultaneously whereby said plunger can be removed from said plunger receiving opening by either a downward pushing or an upward lifting on said lever member to thereby release side foot rest supporting tube and permit swinging to said out-of-the-way second position.

* * * * *